US008915300B2

(12) United States Patent
Sommers et al.

(10) Patent No.: US 8,915,300 B2
(45) Date of Patent: Dec. 23, 2014

(54) VALVE FOR HYDRAULIC FRACTURING THROUGH CEMENT OUTSIDE CASING

(75) Inventors: Michael T Sommers, Broken Arrow, OK (US); Stephen L Jackson, Richmond, TX (US)

(73) Assignee: Team Oil Tools, LP, The Woodlands, TX (US)

( * ) Notice: Subject to any disclaimer, the term of this patent is extended or adjusted under 35 U.S.C. 154(b) by 151 days.

(21) Appl. No.: 13/312,517

(22) Filed: Dec. 6, 2011

(65) Prior Publication Data

US 2013/0056220 A1 Mar. 7, 2013

Related U.S. Application Data

(63) Continuation-in-part of application No. 13/223,909, filed on Sep. 1, 2011, now Pat. No. 8,267,178.

(51) Int. Cl.

| | |
|---|---|
| ***E21B 21/10*** | (2006.01) |
| ***E21B 34/14*** | (2006.01) |
| ***E21B 34/10*** | (2006.01) |
| *E21B 34/00* | (2006.01) |

(52) U.S. Cl.

CPC ..... *E21B 34/102* (2013.01); *E21B 34/103* (2013.01); *E21B 2034/007* (2013.01)

USPC ..... 166/334.4; 166/317; 166/332.1; 166/318; 166/373

(58) Field of Classification Search

CPC ..... E21B 21/103; E21B 34/063; E21B 34/14

USPC ..... 166/373, 386, 318, 332.1, 317, 334.4

See application file for complete search history.

(56) References Cited

U.S. PATENT DOCUMENTS

| | | | | |
|---|---|---|---|---|
| 2,251,977 | A * | 8/1941 | Burt | 166/156 |
| 2,872,983 | A * | 2/1959 | Renouf | 166/141 |
| 4,515,217 | A * | 5/1985 | Stout | 166/297 |
| 5,261,486 | A | 11/1993 | Cornette et al. | |
| 6,079,496 | A * | 6/2000 | Hirth | 166/321 |
| 6,286,594 | B1 * | 9/2001 | French | 166/151 |
| 6,293,342 | B1 * | 9/2001 | McGarian et al. | 166/317 |
| 6,464,008 | B1 * | 10/2002 | Roddy et al. | 166/285 |
| 6,681,860 | B1 * | 1/2004 | Yokley et al. | 166/382 |
| 7,866,402 | B2 | 1/2011 | Williamson, Jr. | |
| 7,909,095 | B2 | 3/2011 | Richards et al. | |
| 7,926,573 | B2 | 4/2011 | Swan et al. | |
| 7,934,559 | B2 * | 5/2011 | Posevina et al. | 166/318 |
| 8,096,363 | B2 | 1/2012 | Williamson, Jr. | |
| 8,267,178 | B1 | 9/2012 | Sommers et al. | |
| 8,695,716 | B2 | 4/2014 | Ravensbergen | |

(Continued)

*Primary Examiner* — Kenneth L Thompson

(74) *Attorney, Agent, or Firm* — MH2 Technology Law Group, LLP

(57) ABSTRACT

A valve includes: a housing; a mandrel disposed in the housing; a rupture disk disposed in a passageway of the mandrel; a sliding sleeve disposed between the housing and the mandrel; and a ball seat disposed in the mandrel. A method for actuating a valve includes: flowing a fluid through the valve; dropping a ball; seating the ball in the ball seat and blocking fluid flow through the mandrel; flowing fluid through the passageway to the sliding sleeve; moving the sliding sleeve axially within the valve; and exiting fluid through the openings of the housing and mandrel. A valve includes: a housing having an opening; a mandrel disposed in the housing; a sliding sleeve disposed between the housing and the mandrel; and a ball seat disposed in the mandrel blocking fluid communication between the mandrel and the passageway.

20 Claims, 8 Drawing Sheets

(56) References Cited

U.S. PATENT DOCUMENTS

2002/0166665 A1 11/2002 Vincent et al.
2008/0093080 A1* 4/2008 Palmer et al. ..... 166/318
2008/0302538 A1 12/2008 Hofman
2009/0095463 A1 4/2009 Swan et al.
2009/0095486 A1* 4/2009 Williamson, Jr. ..... 166/373
2010/0314562 A1* 12/2010 Bisset ..... 251/12
2011/0174491 A1 7/2011 Ravensbergen et al.
2011/0308817 A1* 12/2011 Ravensbergen ..... 166/382
2011/0315389 A1* 12/2011 Crider et al. ..... 166/329

* cited by examiner

VALVE FOR HYDRAULIC FRACTURING THROUGH CEMENT OUTSIDE CASING

CROSS-REFERENCE TO RELATED APPLICATIONS

The present application is a continuation in part of U.S. patent application Ser. No. 13/223,909, filed Sep. 1, 2011, the entire disclosure of which is incorporated by reference herein.

BACKGROUND

1. Field of the Invention

Embodiments disclosed herein relate to apparatuses and methods used in hydraulic fracturing of downhole formations. More specifically, embodiments disclosed herein relate to downhole valves used in hydraulic fracturing operations.

2. Background Art

This section of this document introduces information about and/or from the art that may provide context for or be related to the subject matter described herein and/or claimed below. It provides background information to facilitate a better understanding of the various aspects of the present invention. This is a discussion of "related" art. That such art is related in no way implies that it is also "prior" art. The related art may or may not be prior art. The discussion in this section of this document is to be read in this light, and not as admissions of prior art.

Current designs for valves used in the completion method disclosed above are prone to failure because cement or other debris interferes with the opening of the valve after the cementing process has been completed. Portions of the sliding sleeve or pistons commonly used are exposed to either the flow of cement or the cement flowing between the well bore and the casing string.

SUMMARY OF THE DISCLOSURE

The valve according to the invention overcomes the difficulties described above by isolating a sliding sleeve between an outer housing and an inner mandrel. A rupture disk in the inner mandrel ruptures at a selected pressure. Pressure will then act against one end of the sliding sleeve and shift the sleeve to an open position so that fracturing fluid will be directed against the cement casing. The sliding sleeve includes a rocking ring nut to prevent the sleeve from sliding back to a closed position.

In a first aspect, a valve comprises: a housing having an opening; a mandrel disposed in the housing, the mandrel having an opening; a rupture disk disposed in a passageway of the mandrel; a sliding sleeve disposed between the housing and the mandrel; and a ball seat disposed in the mandrel.

A second aspect includes a method for actuating a valve comprising a housing having an opening; a mandrel having an opening and a passageway; a sliding sleeve disposed between the housing and the mandrel; and a ball seat disposed in the mandrel. The method comprises: flowing a fluid through the valve; dropping a ball; seating the ball in the ball seat and blocking fluid flow through the mandrel; flowing fluid through the passageway to the sliding sleeve; moving the sliding sleeve axially within the valve; and exiting fluid through the openings of the housing and mandrel.

In a third aspect, a valve comprises: a housing having an opening; a mandrel disposed in the housing, the mandrel having an opening and a passageway; a sliding sleeve disposed between the housing and the mandrel; and a ball seat disposed in the mandrel blocking fluid communication between the mandrel and the passageway.

The above presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

BRIEF DESCRIPTION OF DRAWINGS

The invention may be understood by reference to the following description taken in conjunction with the accompanying drawings, in which like reference numerals identify like elements, and in which.

While the invention is susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Figure 1:
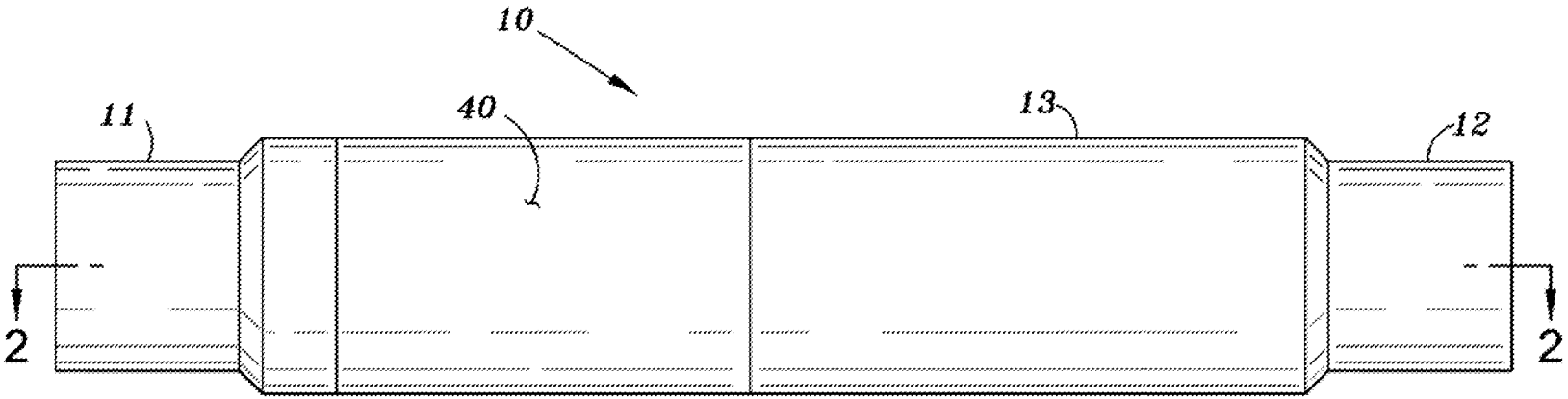
FIG. 1 is a side view of the valve according to one embodiment of the invention.

As shown in FIG. 1, an embodiment of valve 10 of the invention includes a main housing 13 and two similar end connector portions 11, 12.

Figure 2:
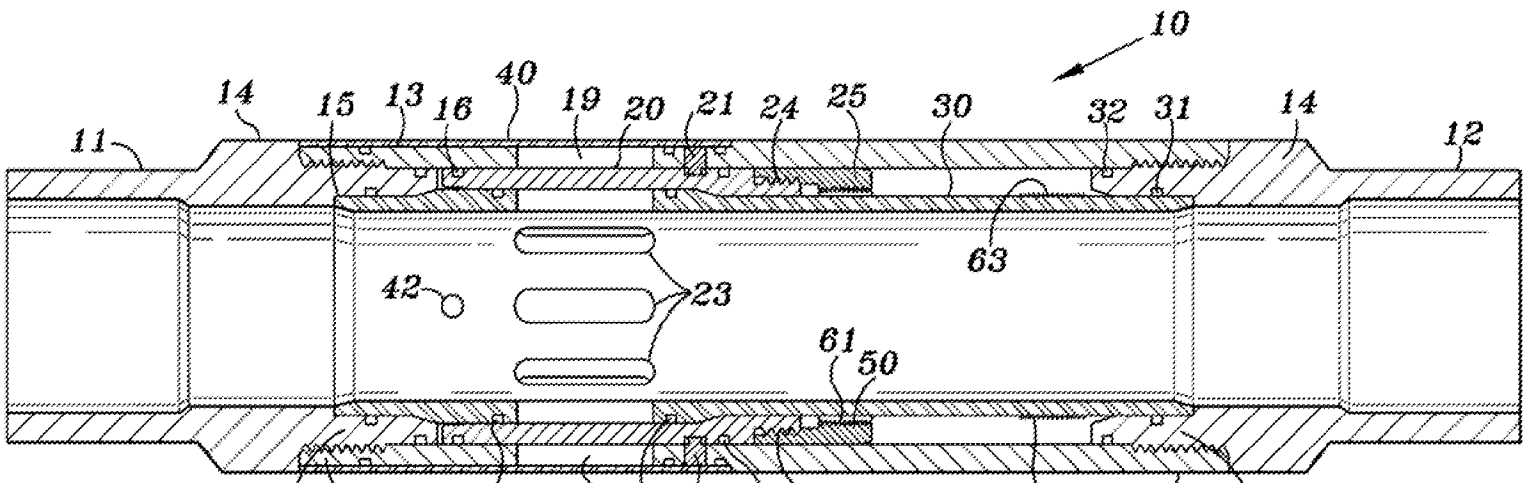
FIG. 2 is a cross sectional view of the valve in the closed position taken along line 2-2 of FIG. 1.

Main housing 13 is a hollow cylindrical piece with threaded portions 61 at each end that receive threaded portions 18 of each end connector. End connectors 11 and 12 may be internally or externally threaded for connection to the casing string. As shown in FIG. 2, main housing 13 includes one or more openings 19, which are surrounded by a circular protective cover 40. Cover 40 is made of high impact strength material.

Figure 3:
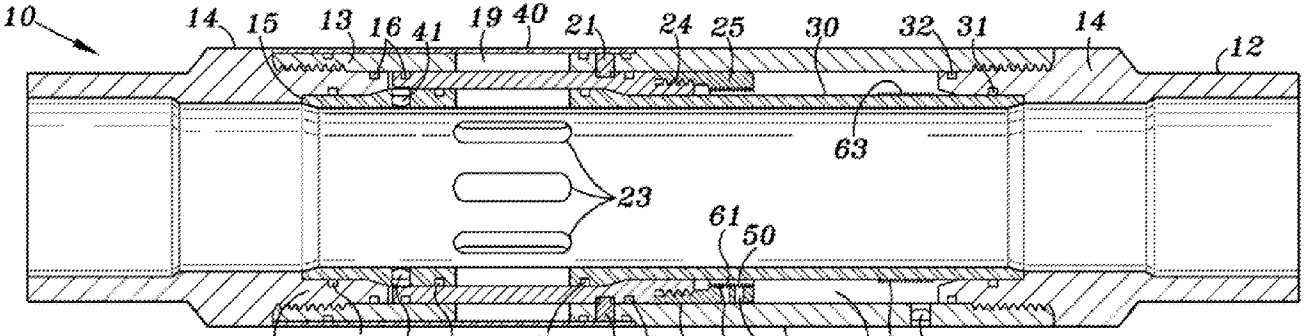
FIG. 3 is a cross sectional view of the valve taken along line 3-3 of FIG. 2.

Valve 10 includes a mandrel 30, which is formed as a hollow cylindrical tube extending between end connectors 11, 12 as shown in FIG. 2. Mandrel 30 includes one or more apertures 23 that extend through the outer wall of the mandrel. Mandrel 30 also has an exterior intermediate threaded portion 51. One or more rupture disks 41, 42 are located in the mandrel as shown in FIG. 3. Rupture disks 41, 42 are located within passageways that extend between the inner and outer surfaces of the mandrel 30. Annular recesses 17 and 27 are provided in the outer surface of the mandrel for receiving suitable seals.

Figure 4:
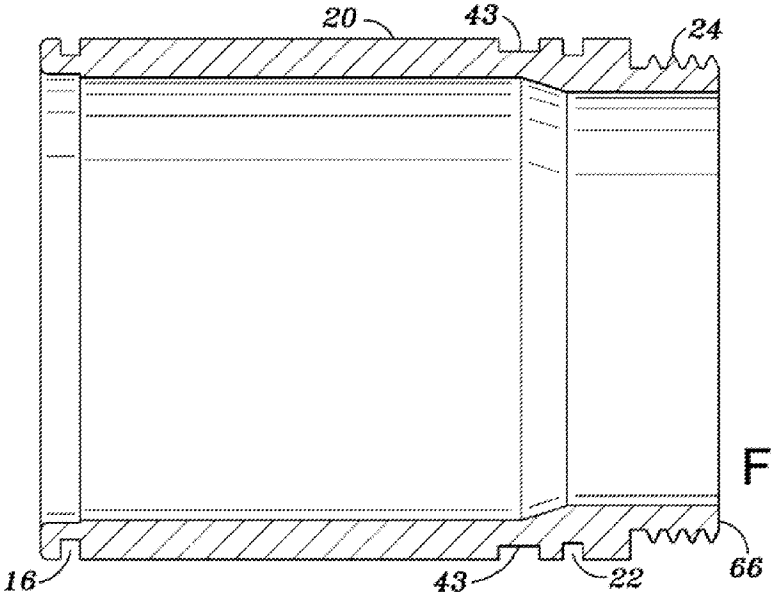
FIG. 4 is a cross sectional view of the sliding sleeve.
Figure 5:
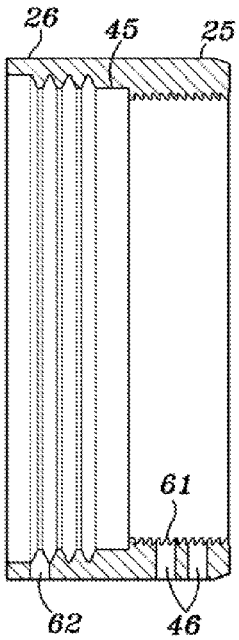
FIG. 5 is a cross sectional view of the locking ring holder.
Figure 6:
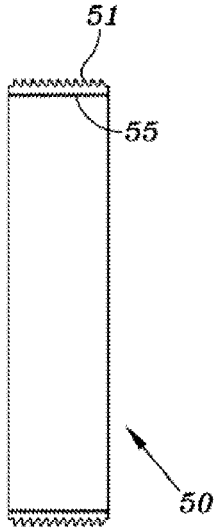
FIG. 6 is a cross sectional view of the locking ring.

Mandrel 30 is confined between end connectors 11 and 12 by engaging a shoulder 15 in the interior surface of the end connectors. End connectors 11 and 12 include longitudinally extending portions 18 that space apart outer housing 13 and mandrel 30 thus forming a chamber 36. Portions 18 have an annular recess 32 for relieving a suitable seal. A sliding sleeve member 20 is located within chamber 36 and is generally of a hollow cylindrical configuration as shown in FIG. 4. The sliding sleeve member 20 includes a smaller diameter portion 24 that is threaded at 66. Also it is provided with indentations 43 that receive the end portions of shear pins 21. Sliding sleeve member 20 also includes annular grooves 16 and 22 that accommodate suitable annular seals.

Figure 7:
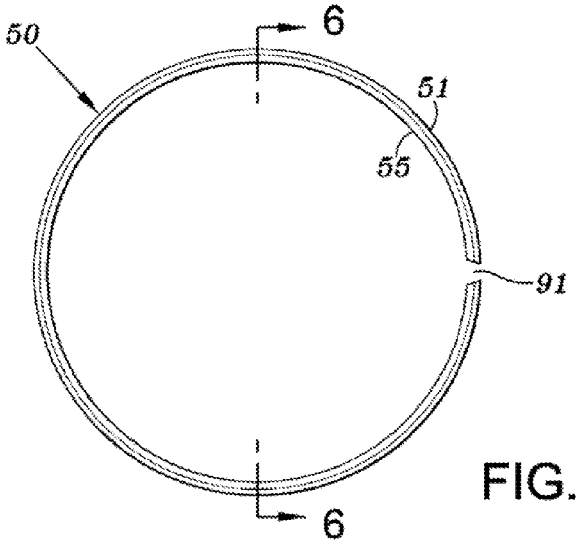
FIG. 7 is an end view of the locking ring.
Figure 8:
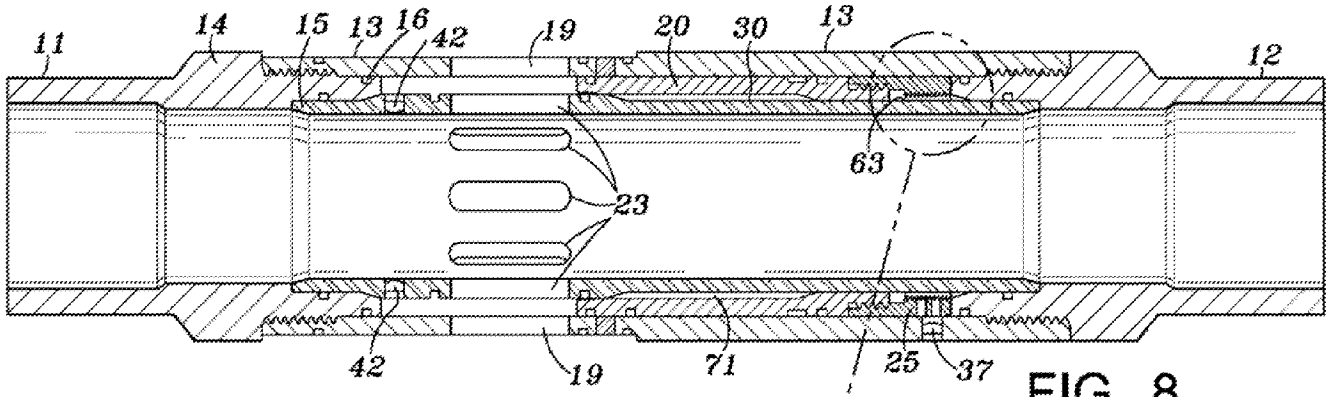
FIG. 8 is a cross sectional view of the valve in the open position.
Figure 9:
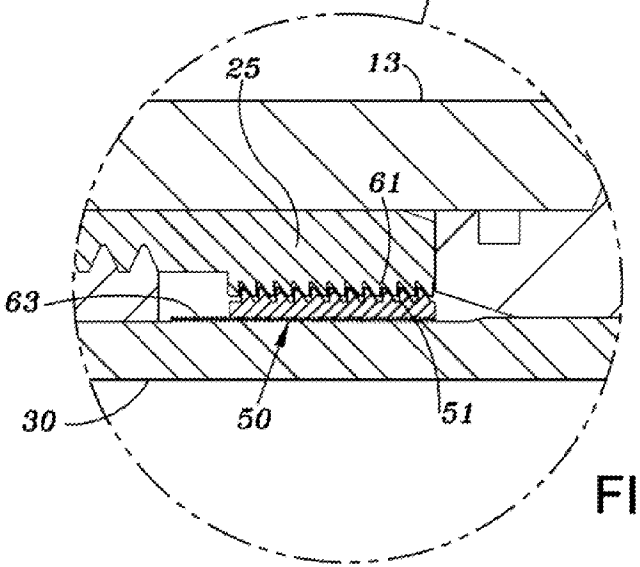
FIG. 9 is an enlarged view of the area circled in FIG. 8.

A locking ring holder 25 has ratchet teeth 61 and holds locking ring 50, which has ratchet teeth 51 on its outer surface and ratchet teeth 55 on its inner surface as shown in FIG. 9. Locking ring 50 includes an opening at 91, as shown in FIG. 7, which allows it to grow in diameter as the sliding sleeve moves from the closed to open position.

Locking ring holder 25 has sufficient diameter clearance so that the locking ring can ratchet on the mandrel ratcheting teeth 63, yet never loose threaded contact with the lock ring holder. Locking ring holder 25 is threaded at 26 for engagement with threads 24 on the mandrel. Locking ring holder 25 also has a plurality of bores 46 and 62 for set screws, not shown.

In use, valve 10 may be connected to the casing string by end connectors 11, 12. One or more valves 10 may be incorporated into the casing string. After the casing string is deployed within the well, cement is pumped down through the casing and out the bottom into the annulus between the well bore and the casing, as typical within the art. After the cement flow is terminated, a plug or other device is pumped down to wipe the casing and valve clean of residual cement. When the plug or other device has latched or sealed in the bottom hole assembly, pressure is increased to rupture the rupture disk at a predetermined pressure. The fluid pressure will act on sliding sleeve member 20 to cause the shear pins to break and then to move it downward or to the right, as shown in FIG. 7. This movement will allow fracing fluid to exit via opening 23 in the mandrel and openings 19 in the outer housing. The fracing fluid under pressure will remove protective cover 40 and crack the cement casing and also fracture the foundation adjacent to the valve 10.

Due to the fact that the sliding sleeve member 20 is mostly isolated from the cement flow, the sleeve will have a lesser tendency to jam or require more pressure for actuation.

In the open position, locking ring 50 engages threads 63 on the mandrel to prevent the sleeve from moving back to the closed position.

A vent 37 is located in the outer housing 13 to allow air to exit when the valve is being assembled. The vent 37 is closed by a suitable plug after assembly.

Figure 10:
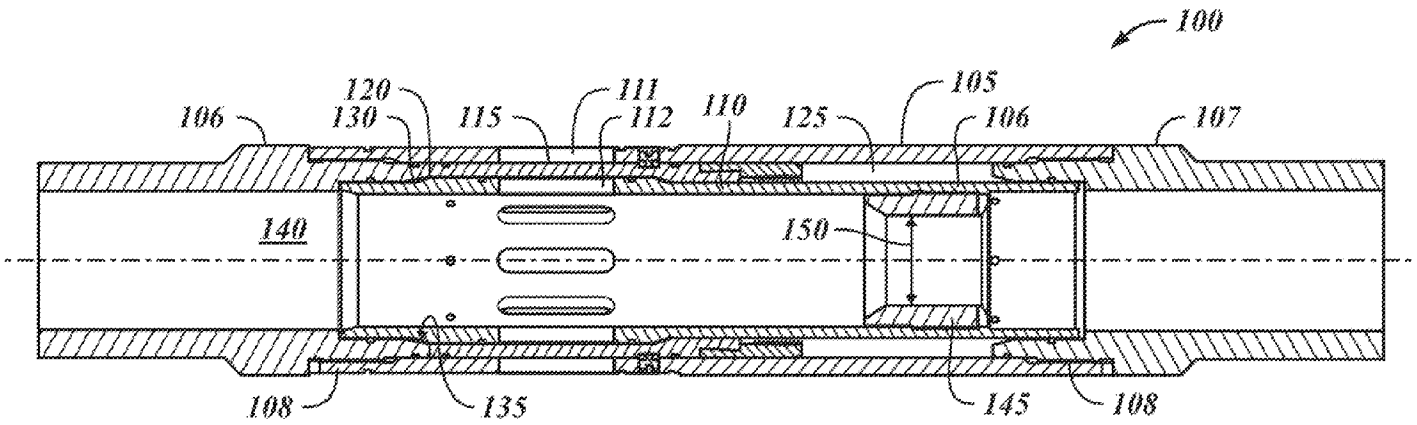
FIG. 10 is a cross-sectional view of a valve in a closed position according to embodiments of the present disclosure.

Referring now to FIG. 10, a cross-sectional view of a valve in a closed position according to an embodiment of the present disclosure is shown. Valve 100 is shown coupled to an upper tool assembly 106 and a lower tool assembly 107. Upper tool assembly 106 and lower tool assembly 107 may include any number of tools used in downhole operations including, for example, packers, sub-assemblies, flow control equipment, etc. Valve 100, upper tool assembly 106, and lower tool assembly 107 are coupled through threadable connections 108. In this embodiment, valve 100 includes a housing 105 and a mandrel 110. Housing 105 and mandrel 110 may be formed from metals known to the art such as, for example, various grades of steel.

Housing 105 has one or more openings 111 located around valve 100. The number, location, and size of openings 111 may vary depending on the requirements for a particular embodiment of valve 100. For example, in certain embodiments, openings 111 may range from several inches to several feet in length. Additionally, the geometry of openings 111 may vary depending on the requirements of a particular operation. For example, in certain embodiments, openings 111 may be generally rectangular, while other embodiments, openings 111 may be more round/circular in geometry. In addition to openings 111 in housing 105, valve 100 also includes one or more corresponding mandrel openings 112. The openings 112 of the mandrel 110 correspond in location to the openings 111 in the housing 105, and as such, the geometry and size of mandrel 110 openings 112 may vary as housing 105 openings 111 vary.

A sliding sleeve 115 is disposed between housing 105 and mandrel 110. In this embodiment, a first chamber 120, is formed between housing 105 and mandrel 110, and is located axially above sliding sleeve 115. Similarly, a second chamber 125 is formed between housing 105 and mandrel 110, and is located below sliding sleeve 115. First and second chambers 120 and 125 are at atmospheric pressure when sliding sleeve 115 is in a closed position. Because the pressure in first and second chambers 120 and 125 is balanced, i.e., both chambers are at atmospheric pressure, the sliding sleeve does not move axially within the chambers 120 and 125, and thus valve 100 remains in a closed position.

A passageway 130 is located axially above sliding sleeve 115 and fluidly connects the inner diameter of mandrel 110 to first chamber 120. In a closed position, a rupture disk 135 may be located in passageway 130, thereby blocking a flow of fluid from the throughbore 140 of valve 100 into first chamber 120. As explained above, rupture disk 135 may be formed of a material that is designed to rupture, or break, at a specified pressure.

For example, in one embodiment, rupture disk 135 may be designed to break at approximately 3000 PSI. In other embodiments, rupture disk 135 may be designed to break at lower or higher pressures, such as, for example 1000 PSI, 5000 PSI, 10000 PSI, or 15000 PSI. The pressure at which rupture disk 135 ruptures may vary depending on specific valve 100 design and operational requirements in a manner that will be readily ascertainable by those skilled in the art having the benefit of this disclosure. For example, the pressure rating of rupture disk 135 may vary as a result of the depth of the well, properties of the fluid being pumped downhole, size of valve 100, etc.

In certain embodiments, multiple rupture disks 135 may be located around the inner diameter of mandrel 110. For example, two rupture disks 135 may be disposed at approximately 180° from one another. Those of ordinary skill in the art will appreciate that during casing of horizontal wells, because one side of the tool is relatively lower, cement may tend to settle on the lower side of the tool. To prevent settled cement from delaying or preventing the actuation of valve 100, multiple rupture disks 135 may be included in valve 100. In the event one of rupture disks 135 on a low side of valve 100 is covered with cement and cannot rupture, a second, redundant rupture disk 135, may be located on a high side of the tool. Because cement has not covered the rupture disk 135 on the high side of valve 100, the rupture disk 135 on the high side will rupture upon valve actuation, thereby allowing valve 100 to open. In a manner that will be readily ascertainable by those skilled in the art having the benefit of this disclosure, in certain valves 100, more than two rupture disks 135 may be included. For example, three, four, five, or more rupture disks 135 may be included to provide additional levels of redundancy.

Valve 100 also includes a ball seat 145 disposed in throughbore 140. In this embodiment, ball seat 145 is coupled to the inner diameter of mandrel 110 and is located axially below housing and mandrel openings 111 and 112. Ball seat 145 is configured to receive a ball (not shown), which may be dropped from the surface in order to actuate valve 100. It will be readily ascertainable to those of ordinary skill in the art that the size opening 150 through ball seat 145 may vary in order to receive a certain diameter ball. For example, ball diameter may size may vary in 1/16th inch increments in operations in which multiple valves 100 are used. In order to allow multiple valves 100 to be actuated along the length of a well, ball seats 145 that correspond to the smallest diameter balls may be disposed at a farthest distal location in the well, relative to the surface, while ball seats 145 that correspond to the largest diameter balls may be disposed at a location proximate the surface. Thus, sequentially larger balls may be dropped, thereby allowing multiple valves 100 to be opened.

Figure 11:
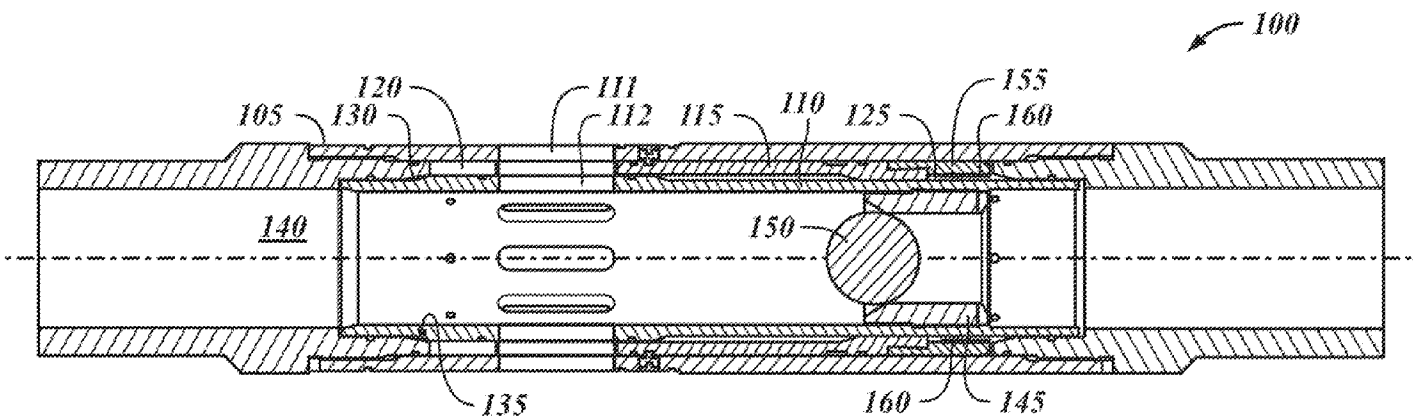
FIG. 11 is a cross-sectional view of a valve in an open position according to embodiments of the present disclosure.

Referring now to FIG. 11, a cross-sectional view of a valve in an open position according to embodiments of the present disclosure is shown. The components of valve 100 correspond to those shown in FIG. 10, as described above. In an open position, sliding sleeve 115 is located axially below housing 105 and mandrel 110, thereby allowing fluid communication between throughbore 140 and the annulus of the casing (not shown).

In order to actuate valve 100 into an open position, a ball 150 is dropped from the surface of the well. The ball 150 is pumped downhole until it contacts and seats against ball seat 145, as shown. As fluid continues to build in throughbore 140, the pressure increases until a selected pressure is reached that causes rupture disk 135 to rupture. As rupture disk 135 ruptures, fluid flows through passageway 130 into first chamber 120. The fluid pressure in the tubing forces sliding sleeve 115 to traverse axially downward into second chamber 125. Sliding sleeve 115 may then be locked into place through engagement of corresponding teeth 160 on a lock ring 155 and mandrel 105. The lock ring 155 may then permanently secure sliding sleeve 115 in an open position, thereby allowing full fluid flow through housing and mandrel openings 111 and 112.

Figure 12:
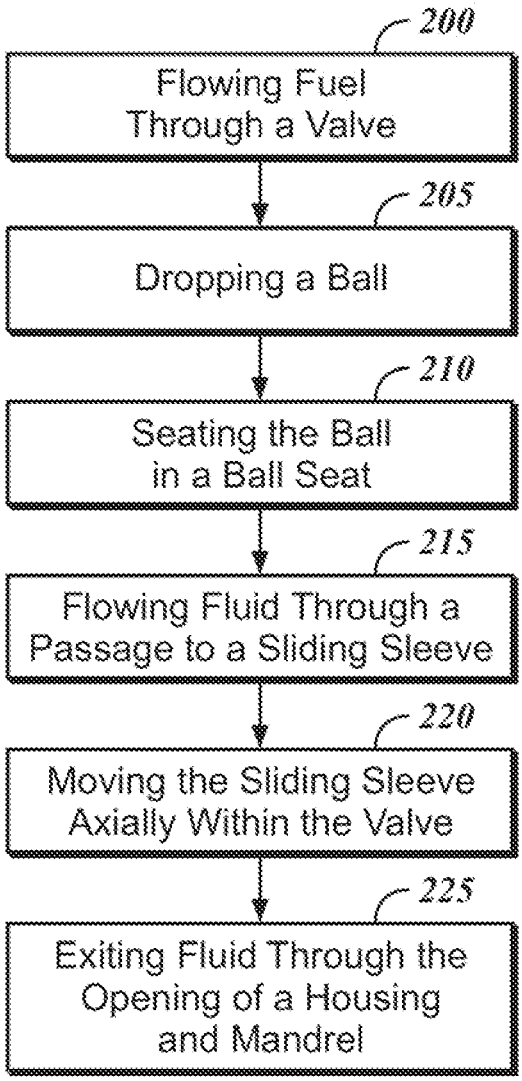
FIG. 12 is a flow chart of a method for actuating a valve according to embodiments of the present disclosure.

Referring to FIG. 12, a flow chart of a method for actuating a valve according to embodiments of the present disclosure is shown. The flow chart is provided to further illustrate and clarify actuation of the valve discussed above. During completion of a well, prior to production, the well is cased by pumping cement into the well. Cement is pumped downhole through a throughbore of the valve. The cement exits a casing string (not shown) into an annular section of the well formed between the casing string and the formation. After the cementing operation is complete, a wiping device (not shown), such as a wiper plug, is typically run through the casing string. The wiper plug is forced downward with a flow of fluid and is designed to remove residual cement from the inner diameter of the casing string, including along the inner diameter of the valve, discussed above.

The casing string may include a number of tools, such as packers, which may be used to isolate sections of the well. As it is common for a well to include numerous production zones, particular production zones may be isolated by disposing one or more packers below and/or above the production zone. Along the casing string between the packers one or more valves may be disposed, thereby allowing fluid, such as a fracing fluid to be pumped downhole to fracture the formation.

In order to actuate a valve and allow fracing fluid to fracture formation, fluid is initially flowed (at 200) through the valve. In this embodiment, the valve has a housing having an opening, a mandrel having an opening and a passageway, a sliding sleeve disposed between the housing and the mandrel, and a ball seat disposed in the mandrel. To actuate the valve, a ball is dropped (at 205) from the surface and pumped downhole. Once in the valve, the ball seats (at 210) into the ball seat, thereby blocking the flow of fluid through the mandrel. Because the flow of fluid is blocked, a pressure differential is created above and below the seated ball. Pressure increases above the seated ball until a selected pressure is reached, at which point a rupture disk ruptures, and fluid flows through a passageway connecting the throughbore of the valve with a first chamber.

Fluid flows (at 215) through the passageway into the first chamber and into contact with the sliding sleeve. The sliding sleeve moves (at 220) axially downward between the housing and the mandrel into a second chamber. As the sliding sleeve moves (at 220) downward, fluid communication is allowed between the throughbore of the valve and the casing and/or formation of the well. More specifically, fluid exits (at 225) the valve through the openings in the housing and Mandrel.

In certain embodiments, the sliding sleeve may lock into an open position through engagement of ratcheting teeth of a lock ring of the sliding sleeve and corresponding ratcheting teeth of the mandrel. In alternative embodiments, sliding sleeve may not be locked into place. In such an embodiment, the fluid pressure may hold the sliding sleeve in an open position.

Figure 13:
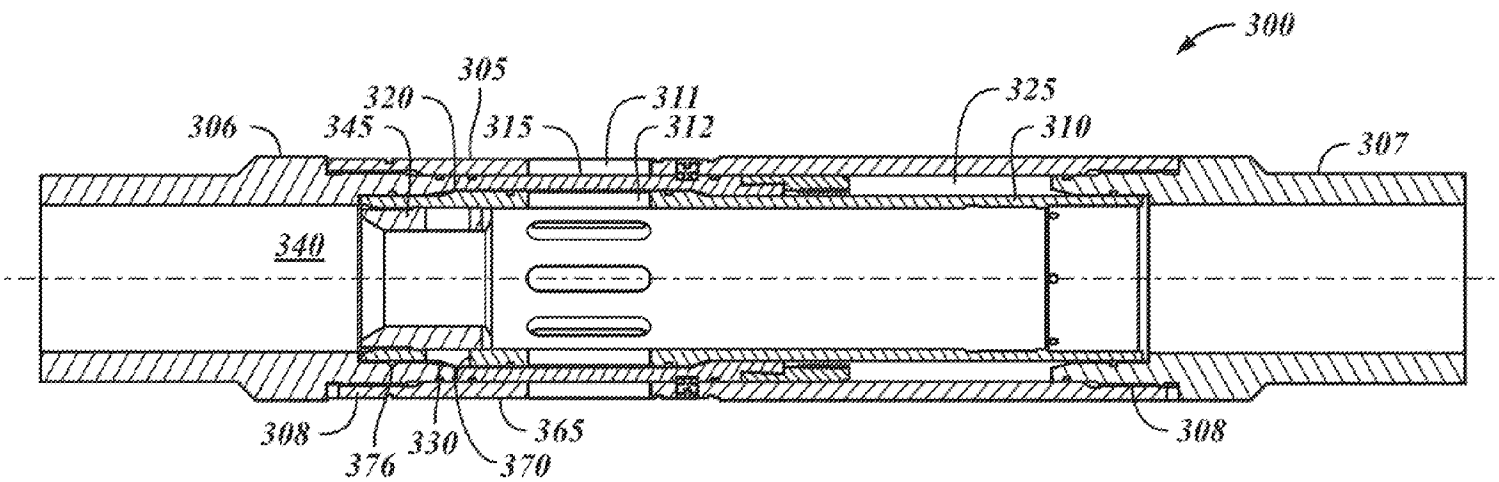
FIG. 13 is a cross-sectional view of a valve in an open position according to embodiments of the present disclosure.

Referring to FIG. 13, a cross-sectional view of a valve in a closed position according to embodiments of the present disclosure is shown. Valve 300 is shown coupled to an upper tool assembly 306 and a lower tool assembly 307. As explained above, upper tool assembly 306 and lower tool assembly 307 may include any number of tools used in downhole operations including, for example, packers, sub-assemblies, flow control equipment, etc. Valve 300, upper tool assembly 306, and lower tool assembly 307 are coupled through threadable connections 308. In this embodiment, valve 300 includes a housing 305 and a mandrel 310.

Housing 305 has one or more openings 311 located at various locations around valve 300. In addition to openings 311 in housing 305, valve 300 also includes one or more corresponding mandrel openings 312. Mandrel 310 openings 312 correspond in location to housing 305 openings 311, and as such, the geometry and size of mandrel 310 openings 312 may vary as housing 305 openings 311 vary.

A sliding sleeve 315 is disposed between housing 305 and mandrel 310. In this embodiment, a first chamber 320, is formed between housing 305 and mandrel 310, and is located axially above sliding sleeve 315. Similarly, a second chamber 325 is formed between housing 305 and mandrel 310, and is located below sliding sleeve 315. First and second chambers 320 and 325 are at atmospheric pressure when sliding sleeve 315 is in a closed position. Because the pressure in first and second chambers 320 and 325 is balanced, i.e., both chambers are at atmospheric pressure, the sliding sleeve does not move axially within the chambers 320 and 325, and thus valve 300 remains in a closed position.

A passageway 330 is located axially above sliding sleeve 315 and fluidly connects the inner diameter of mandrel 310 to first chamber 320. Valve 300 also includes a ball seat 345 disposed in throughbore 340. Ball seat 345 is located above openings 311 and 312 and is positioned to prevent fluid communication between throughbore 340 and first chamber 320. Ball seat 345 is connected to mandrel 310 through one or more shear pins 365. Additionally, one or more seals 370 may be disposed between ball seat 345 and mandrel 310 above and below passageway 330, thereby effectively isolating passageway 330 from throughbore 340. Because passageway 330 is isolated from throughbore 340, balanced pressure in first and second chambers 320 and 325 may be maintained.

Figure 14:
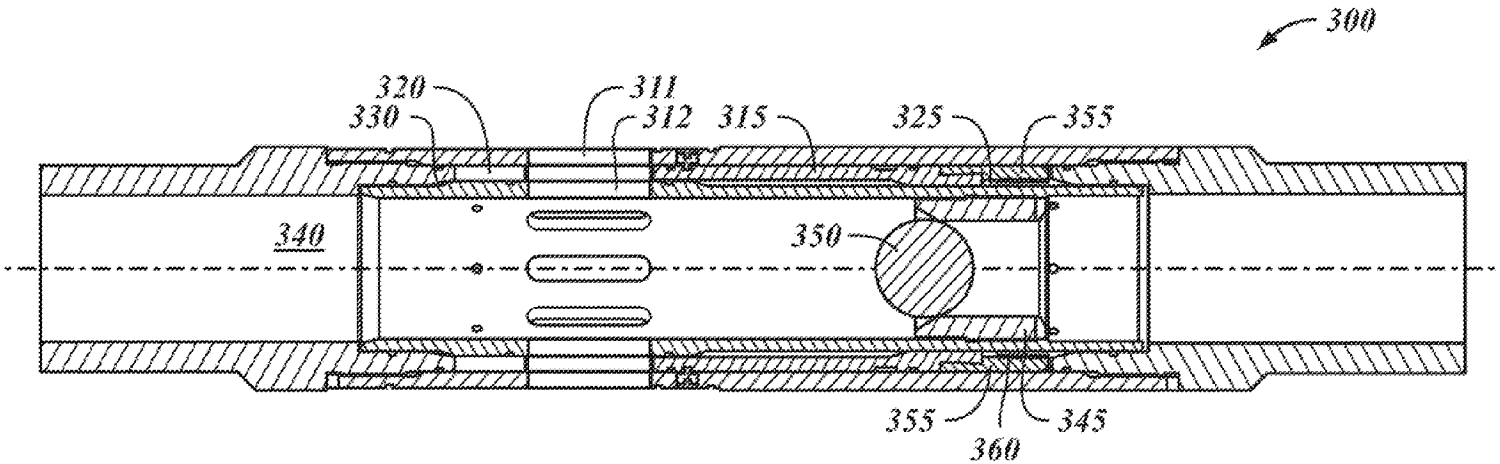
FIG. 14 is a cross-sectional view of a valve in a closed position according to embodiments of the present disclosure.

Referring now to FIG. 14, a cross-sectional view of the valve of FIG. 13 in an open position according to embodiments of the present disclosure is shown. The components of valve 300 correspond to those shown in FIG. 13, as described above. In an open position, sliding sleeve 315 is located axially below housing and mandrel openings 311 and 312, thereby allowing fluid communication between throughbore 340 and the casing (not shown).

In order to actuate valve 300 into an open position, a ball 350 is dropped from the surface of the well. The ball 350 is pumped downhole until it contacts and seats against ball seat 345. As fluid continues to be pumped into throughbore 340, pressure increases until a selected pressure is reached that causes shear pins 360 to break. The breaking of shear pins 360 causes ball seat 345 to move axially within throughbore 340 into a final open position. As ball seat 345 moves, fluid flows through passageway 330 into first chamber 320. The fluid pressure in the tubing forces sliding sleeve 315 to traverse axially downward into second chamber 325. Sliding sleeve 315 may then be locked into place through engagement of corresponding teeth 360 on lock ring 355 and mandrel 305. The lock ring 355 may then permanently secure sliding sleeve 315 into an open position, thereby allowing full fluid flow through housing and mandrel openings 311 and 312.

In certain embodiments, a rupture disk (not shown) may be disposed in passageway 330. In such an embodiment, the rupture disk may serve as an additional check to prevent premature actuation of valve 300. Thus, even if ball seat 345 moved prematurely, valve 300 would not open until the selected increased pressure was reached.

Figure 15:
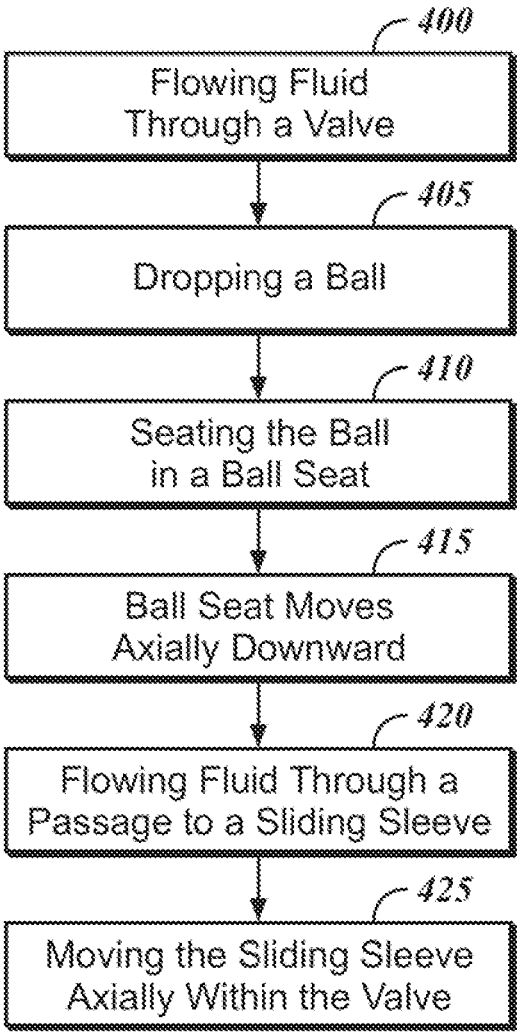
FIG. 15 is a flow chart of a method for actuating a valve according to embodiments of the present disclosure.

Referring to FIG. 15, a flow chart of a method for actuating a valve of FIGS. 13 and 14 according to embodiments of the present disclosure is shown. The flow chart is provided to further clarify actuation of the valve discussed above.

In order to actuate a valve and allowing fracing fluid to fracture formation, fluid is initially flowed 400 through the valve. In this embodiment, the valve has a housing having an opening, a mandrel having an opening and a passageway, a sliding sleeve disposed between the housing and the mandrel, and a ball seat disposed in the mandrel. To actuate the valve, a ball is dropped (at 405) from the surface and pumped downhole. Once in the valve, the ball seats (at 410) into the ball seat, thereby blocking the flow of fluid through the mandrel. Because the flow of fluid is blocked, a pressure is applied to the ball seat, breaking shear pins holding the ball seat in place, and causing the ball seat to move (at 415) axially downward.

Fluid flows (at 420) through the passageway into a first chamber and into contact with the sliding sleeve. The sliding sleeve moves (at 425) axially downward between the housing and the mandrel into a second chamber. As the sliding sleeve moves (at 425) downward, fluid communication is allowed between the throughbore of the valve and the casing and/or formation of the well.

Advantageously, embodiments of the present disclosure may provide for valves used in hydraulic fracturing operations that open fully, thereby allowing for more effective fracing operations. Also advantageously, embodiments of the present disclosure may provide valves with redundant systems to prevent premature actuation of the downhole valve.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A valve comprising:
   - a housing having a radially oriented opening through the wall thereof;
   - a mandrel disposed in the housing, the mandrel having a radially oriented opening through the wall thereof;
   - a sliding sleeve disposed between the housing and the mandrel to move between a closed position in which fluid communication between the openings in the housing and mandrel is blocked and an open position in which the openings in the housing and mandrel are in fluid communication;
   - a rupture disk that, upon rupture, permits application of a fluid pressure to actuate the sliding sleeve between the open and closed positions; and
   - a ball seat disposed in the mandrel.

2. The valve of claim 1, wherein the sliding sleeve blocks fluid communication between the opening in the housing and the opening in the mandrel when the valve is in a closed position.

3. The valve of claim 1, wherein the sliding sleeve is configured to traverse axially within the housing about the mandrel.

4. The valve of claim 1, further comprising a ball disposed in the ball seat.

5. The valve of claim 1, wherein the rupture disk is located axially above the sliding sleeve or is disposed in a passageway of the mandrel.

6. The valve of claim 1, wherein the ball seat is located axially below the rupture disk.

7. The valve of claim 1, wherein a first chamber is located between the mandrel and the housing axially above the openings of the mandrel and the housing and a second chamber located between the mandrel and the housing axially below the openings of mandrel and the housing.

8. The valve of claim 7, wherein the first chamber and the second chamber are at atmospheric pressure when the valve is in a closed position.

9. A method for actuating a valve, the method comprising:
   - flowing a fluid through the valve, the valve comprising;

a housing having a radially oriented opening through the wall thereof;

a mandrel having a radially oriented opening through the wall thereof and a passageway;

a sliding sleeve disposed between the housing and the mandrel to move between a closed position in which fluid communication between the openings in the housing and mandrel is blocked and an open position in which the openings in the housing and mandrel are in fluid communication; and a ball seat disposed in the mandrel:

dropping a ball;

seating the ball in the ball seat and blocking fluid flow through the mandrel;

flowing fluid through the passageway to the sliding sleeve upon the ball seating and blocking fluid flow through the mandrel;

moving the sliding sleeve axially within the valve responsive to the fluid pressure exerted by the fluid flowing through the passageway; and exiting fluid through the openings of the housing and mandrel upon axially moving the sliding sleeve.

10. The method of claim 9, wherein the valve further comprises a rupture disk that, upon rupture, permits application of a fluid pressure to actuate the sliding sleeve between the open and dosed positions.

11. The method of claim 10, further comprising rupturing the rupture disk by the seating of the ball in the ball seat.

12. The method of claim 9, wherein seating the ball in the ball seat slides the ball seat axially within the mandrel.

13. The method of claim 9, further comprising locking the sliding sleeve to at least one of the mandrel and the housing.

14. The method of claim 9, wherein in the ball seat is axially below the opening in the housing and the opening in the mandrel.

15. A valve comprising:

a housing having a radially oriented opening in the wall thereof;

a mandrel disposed in the housing, the mandrel having, a radially oriented opening and a passageway in the wall thereof;

a sliding sleeve disposed between the housing and the mandrel, the sliding sleeve being configured to move between a dosed position in which fluid communication between the openings in the housing and mandrel is blocked and an open position in which the openings in the housing and mandrel are in fluid communication; and ball seat disposed in the mandrel, the ball seat being configured to open fluid communication between the openings in the mandrel and the passageway in a first position and blocking fluid communication between the openings in the mandrel and the passageway in a second position.

16. The valve of claim 15, further comprising a rupture disk that, upon rupture, permits application of a fluid pressure to actuate the sliding sleeve between the open and closed positions.

17. The valve of claim 15, wherein the ball seat is configured to move axially within the mandrel.

18. The valve of claim 15, wherein moving the ball seat axially within the mandrel allows fluid communication between the opening in the mandrel and the passageway.

19. The valve of claim 15, wherein a first chamber is located between the mandrel and the housing axially above the openings of the mandrel and the housing and a second chamber located between the mandrel and the housing axially below the openings of the mandrel and the housing.

20. The valve of claim 19, wherein pressure in the first chamber and second chamber is balanced.

* * * * *